US006037546A

United States Patent [19]

Mottine et al.

[11] Patent Number: 6,037,546

[45] Date of Patent: Mar. 14, 2000

[54] SINGLE-JACKETED PLENUM CABLE

[75] Inventors: John J. Mottine, Phoenix; Kenneth S. Koehler, Glendale; Sayed J. Mirkazemi, Peoria; William B. Dawson, Phoenix, all of Ariz.

[73] Assignee: Belden Communications Company, Phoenix, Ariz.

[21] Appl. No.: 09/113,949

[22] Filed: Jul. 10, 1998

Related U.S. Application Data

[63] Continuation-in-part of application No. 08/857,018, May 15, 1997, abandoned, which is a continuation-in-part of application No. 08/640,262, Apr. 30, 1996.

[51] Int. Cl.[7] ..... H01B 7/00

[52] U.S. Cl. ..... 174/110 PM; 174/113 R; 174/121 A

[58] Field of Search ..... 174/110 PM, 110 FC, 174/110 F, 113 R, 120 R, 121 A

[56] References Cited

U.S. PATENT DOCUMENTS

| | | | |
|---|---|---|---|
| 3,516,859 | 6/1970 | Gerland et al. . | |
| 3,692,924 | 9/1972 | Nye . | |
| 4,412,094 | 10/1983 | Dougherty et al. . | |
| 4,605,818 | 8/1986 | Arroyo et al. . | |
| 4,692,381 | 9/1987 | Pecsok . | |
| 4,781,433 | 11/1988 | Arroyo et al. . | |
| 4,804,702 | 2/1989 | Bartoszek . | |
| 4,881,794 | 11/1989 | Bartoszek . | |
| 4,969,706 | 11/1990 | Hardin et al. . | |
| 5,110,998 | 5/1992 | Muschiatti | 174/110 F X |
| 5,173,960 | 12/1992 | Dickinson . | |
| 5,268,531 | 12/1993 | Nguyen et al. . | |
| 5,276,759 | 1/1994 | Nguyen et al. . | |
| 5,563,377 | 10/1996 | Arpin et al. . | |
| 5,600,097 | 2/1997 | Bleich et al. . | |
| 5,670,748 | 9/1997 | Gingue et al. . | |
| 5,770,820 | 6/1998 | Nelson et al. | 174/121 A X |
| 5,814,768 | 9/1998 | Wessels et al. | 174/110 FC |

OTHER PUBLICATIONS

UL–444 Standard for Safety Communications Cables, Jun. 1994.

UL–910 Burn Test, Mar. 1991.

TIA/EIA Standard, Commercial Building Telecommunications Cabling Standard, Oct. 1995.

*Primary Examiner*—Kristine Kincaid
*Assistant Examiner*—Chau N. Nguyen
*Attorney, Agent, or Firm*—Snell & Wilmer L.L.P.

[57] ABSTRACT

A communications cable having superior electrical characteristics and meeting the burn requirements for plenum applications has a core formed of one or more twisted wire pairs having primary insulation formed of a suitable material, such as high density polyethylene. The core is surrounded by a single outer jacket formed from a material having excellent heat/flame resistance characteristics and acceptable electrical characteristics that are substantially stable at relatively high temperatures, such as a foamed thermoplastic halogenated polymer, for example polyvinylidene fluoride material. The electrical conductors utilized by the cable are oversized (relative to conventional 24 gauge conductors) to enhance the electrical performance of the cable. An air gap formed between the conductor core and the outer jacket further enhances the electrical performance of the cable. In addition, the cable employs twisted pairs having specific twist lengths that enable the cable to exceed the electrical performance of conventional Category 5 cables.

8 Claims, 13 Drawing Sheets

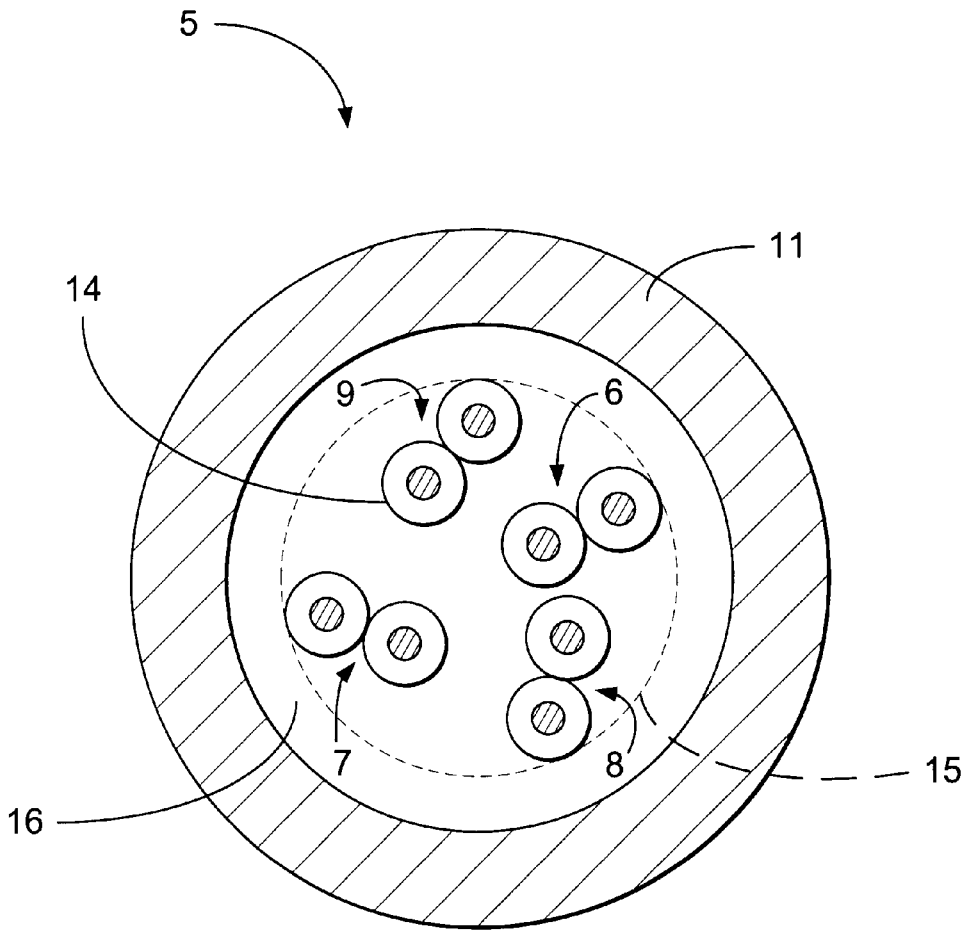
FIG. IA

| f (MHz) | 0.772 | 1 | 4 | 8 | 10 | 16 | 20 | 25 | 31.25 | 62.5 | 100 | MIN (dB) | $f_{MIN}$ (MHz) |
|---|---|---|---|---|---|---|---|---|---|---|---|---|---|
| CAT 5 MIN (dB) | 64 | 62 | 53 | 48 | 47 | 44 | 42 | 41 | 39 | 35 | 32 | | |
| PAIR #1/PAIR #2 (Deviation in dB) | 18.8 | 27.3 | 23.7 | 22.3 | 24.4 | 22.5 | 26.9 | 24.0 | 25.5 | 25.8 | 25.0 | 13.4 | 67.2 |
| PAIR #1/PAIR #3 (Deviation in dB) | 13.8 | 12.7 | 12.0 | 15.0 | 29.0 | 11.9 | 18.6 | 15.9 | 14.2 | 13.8 | 14.3 | 10.0 | 3.8 |
| PAIR #1/PAIR #4 (Deviation in dB) | 16.7 | 25.0 | 20.4 | 13.6 | 11.6 | 14.6 | 23.1 | 11.9 | 27.1 | 14.0 | 20.0 | 8.3 | 2.0 |
| PAIR #2/PAIR #3 (Deviation in dB) | 13.1 | 11.8 | 10.2 | 19.7 | 15.9 | 13.0 | 19.4 | 13.9 | 27.0 | 12.9 | 22.6 | 6.8 | 58.5 |
| PAIR #2/PAIR #4 (Deviation in dB) | 20.8 | 19.1 | 25.7 | 21.8 | 25.7 | 20.6 | 29.8 | 21.1 | 24.9 | 18.6 | 20.7 | 13.0 | 2.5 |
| PAIR #3/PAIR #4 (Deviation in dB) | 26.0 | 24.3 | 20.7 | 19.2 | 16.1 | 18.3 | 16.0 | 19.5 | 25.9 | 21.7 | 25.0 | 12.4 | 37.1 |

FIG. 4G - NEXT MEASUREMENTS

| f (MHz) | 0.772 | 1 | 4 | 8 | 10 | 16 | 20 | 25 | 31.25 | 62.5 | 100 | MIN (dB) | $f_{MIN}$ (MHz) |
|---|---|---|---|---|---|---|---|---|---|---|---|---|---|
| CAT 5 MIN (dB) | 64 | 62 | 53 | 48 | 47 | 44 | 42 | 41 | 39 | 35 | 32 | | |
| PAIR #1 (Deviation in dB) | 11.1 | 12.3 | 11.2 | 10.9 | 11.3 | 9.8 | 16.5 | 10.2 | 13.6 | 10.8 | 12.6 | 6.5 | 2.0 |
| PAIR #2 (Deviation in dB) | 11.5 | 10.9 | 9.9 | 16.2 | 15.0 | 11.9 | 18.0 | 12.7 | 20.6 | 11.7 | 17.5 | 6.2 | 2.1 |
| PAIR #3 (Deviation in dB) | 10.3 | 9.0 | 7.8 | 12.6 | 12.9 | 8.9 | 12.8 | 11.1 | 13.4 | 10.0 | 13.4 | 5.4 | 22.0 |
| PAIR #4 (Deviation in dB) | 14.9 | 17.1 | 16.9 | 12.0 | 10.2 | 12.3 | 14.9 | 10.7 | 20.1 | 12.2 | 15.7 | 7.0 | 2.0 |

FIG. 5E - NEXT POWER SUM MEASUREMENTS

| f (MHz) | 0.772 | 1 | 4 | 8 | 10 | 16 | 20 | 25 | 31.25 | 62.5 | 100 |
|---|---|---|---|---|---|---|---|---|---|---|---|
| CAT 5 MAX (dB) | 1.8 | 2.0 | 4.1 | 5.8 | 6.5 | 8.2 | 9.3 | 10.4 | 11.7 | 17.0 | 22.0 |
| PAIR #1 (dB) | 1.6 | 1.8 | 3.7 | 5.4 | 6.1 | 7.9 | 8.9 | 10.1 | 11.3 | 16.6 | 21.3 |
| PAIR #2 (dB) | 1.6 | 1.8 | 3.8 | 5.5 | 6.2 | 8.0 | 9.0 | 10.2 | 11.5 | 16.8 | 21.7 |
| PAIR #3 (dB) | 1.5 | 1.7 | 3.6 | 5.3 | 6.0 | 7.7 | 8.7 | 9.9 | 11.1 | 16.3 | 21.1 |
| PAIR #4 (dB) | 1.5 | 1.7 | 3.6 | 5.2 | 5.8 | 7.5 | 8.5 | 9.6 | 10.9 | 16.0 | 20.7 |

FIG. 7 - ATTENUATION MEASUREMENTS

SINGLE-JACKETED PLENUM CABLE

RELATED APPLICATIONS

This application is a Continuation-In-Part of U.S. patent application Ser. No. 08/857,018, filed May 15, 1997 now abandoned, which is a Continuation-In-Part of U.S. patent application Ser. No. 08/640,262, filed Apr. 30, 1996.

FIELD OF THE INVENTION

This invention relates to a communications cable suitable for plenum, riser, and other applications in building structures. More particularly, the present invention relates to an improved construction for a high-frequency communications cable that is capable of meeting rigorous burn requirements and is electrically stable during operation at substantially higher temperatures than prior art cables.

BACKGROUND OF THE INVENTION

It is common practice to route communication cables and the like for computers, data devices, and alarm systems through plenums in building constructions. If a fire occurs in a building which includes plenums or risers, however, the non-fire retardant plenum construction would enable the fire to spread very rapidly throughout the entire building. Fire could travel along cables installed in the plenum, and smoke originating in the plenum could be conveyed to adjacent areas of the building.

A non-plenum rated cable sheath system, which encloses a core of insulated copper conductors, and which utilizes only a conventional plastic jacket, may not exhibit acceptable flame spread and smoke generation properties. As the temperature in such a cable rises due to a fire, charring of the jacket material may occur. If the jacket ruptures, the interior of the jacket and the insulation are exposed to elevated temperatures. Flammable gases can be generated, propagating flame and generating smoke.

Generally, the National Electrical Code requires that power-limited cables in plenums be enclosed in metal conduits. This is obviously a very expensive construction due to the cost of materials and labor involved in running conduit or the like through plenums. The National Electrical Code does, however, permit certain exceptions to the requirements so long as such cables for plenum use are tested and approved by an independent testing laboratory, such as the Underwriters Laboratory (UL), as having suitably low flame spread and smoke-producing characteristics. The flame spread and smoke production characteristics of plenum cable are tested and measured per the UL-910 plenum burn standard.

With plenum cables, in addition to concerns about flammability and smoke production, the cables must also, of course, have suitable electrical characteristics for the signals intended to be carried by the cables. There are various categories of cable, such as Category 3, Category 4, Category 5, etc., with increasing numbers referring to enhanced or higher frequency electrical transmission capabilities. With Category 5, for example, extremely good electrical parameters are required, including low attenuation, structural return loss, and cross-talk values for frequencies up to 100 MHz. Unfortunately, cable materials which generally have the requisite resistance to flammability and smoke production also result in electrical parameters for the cable generally not suitable for the higher transmission rates, such as a Category 5 cable. Specifically, Category 5 plenum cables must: (1) pass the UL-910 plenum burn test; (2) pass physical property testing set forth in the UL-444 standard relating to communications cables; and (3) meet the Category 5 electrical requirements such as provided in Electronic Industries Association specification TIA/EIA-568A.

Currently, a cable construction which is available and which meets these requirements is provided in a configuration which includes fluorinated ethylene propylene (FEP) as insulation, with a low-smoke polyvinyl chloride (PVC) jacket. Such a cable construction meets the 100 MHz frequency operation requirements, and it has been demonstrated that such a cable construction can be suitable for asynchronous transfer mode (ATM) applications. Unfortunately, FEP at times may be in short supply. Given the manufacturing capacity of FEP producers, only enough FEP is currently produced to meet approximately 80 percent of the demand for the volume of material required to construct high-category cables. Although it could be expected that the supply of FEP will continue to increase, it is apparent that the available quantity of FEP may not meet the demand for the material for use in plenum cables as the domestic market is projected to increase at a rate of approximately 20 percent per year in the near future, and the potential use of such Category 5 plenum cables in European and Scandinavian markets may further increase the demand for FEP.

One current riser cable utilizes a foam/skin insulation. The insulation material construction is a foamed, high density polyethylene and PVC skin composite. A jacketed and shielded cable of this insulation core can be designed to meet the Category 3 electrical and the plenum burn requirements. However, developing a Category 5 plenum cable is very difficult due to the extreme electrical parameters necessary, e.g., attenuation, structural return loss, and cross-talk values to 100 MHz. Furthermore, this core must pass elevated temperature attenuation requirements at 40° C. and 60° C. The above-mentioned insulation composite with a PVC skin will not pass the elevated temperature attenuation requirements because the dielectric constant of PVC increases with temperature.

SUMMARY OF THE INVENTION

It is an advantage of this invention to provide a cable construction suitable for high frequency electrical applications while at the same time being resistant to burning.

A more specific advantage of this invention to provide a cable design that meets Category 5 or higher electrical parameters, including elevated temperature attenuation requirements, while at the same time satisfying the burn rating standards for plenum cable.

It is an additional advantage of this invention to provide a cable construction which meets the electrical and burn rating requirements and additionally meets various physical requirements such as cold bend, room temperature and aged tensile strength, elongation, and the like, required for plenum cables.

It is another advantage of this invention to provide such a cable construction meeting the above requirements, which does not utilize FEP, and which is suitable for 100 MHz applications.

A further advantage of the present invention is that it provides a cable construction having an outer jacket construction that exhibits electrically stable characteristics at substantially high temperatures, relative to the temperature requirements of currently available plenum cables.

The above and other advantages of the present invention may be carried out in one form by an improved communications cable for use in plenum applications. The cable may include a plurality of conductors, each being individually enclosed by a substantially pure high density polyethylene (HDPE) insulating material, a polyvinylidene fluoride (PVDF) outer jacket surrounding the plurality of conductors, and an air gap formed between the conductors and the outer jacket. The conductors, the insulation material, the air gap, and the outer jacket are cooperatively configured such that the cable passes the UL-910 plenum burn test and such that the cable meets the Category 5 electrical requirements set forth in the TIA/EIA 568A standard.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

FIG. 1A is a cross sectional view of a cable arrangement in accordance with the present invention;

FIG. 4G is a table of experimental test data points taken from the graphs of FIGS. 4A–4F;

FIG. 5E is a table of experimental test data points taken from the graphs of FIGS. 5A–5D;

FIG. 7 is a table of experimental attenuation test results for a cable configured in accordance with the present invention.

DETAILED DESCRIPTION OF PREFERRED EXEMPLARY EMBODIMENTS

Figure 1:
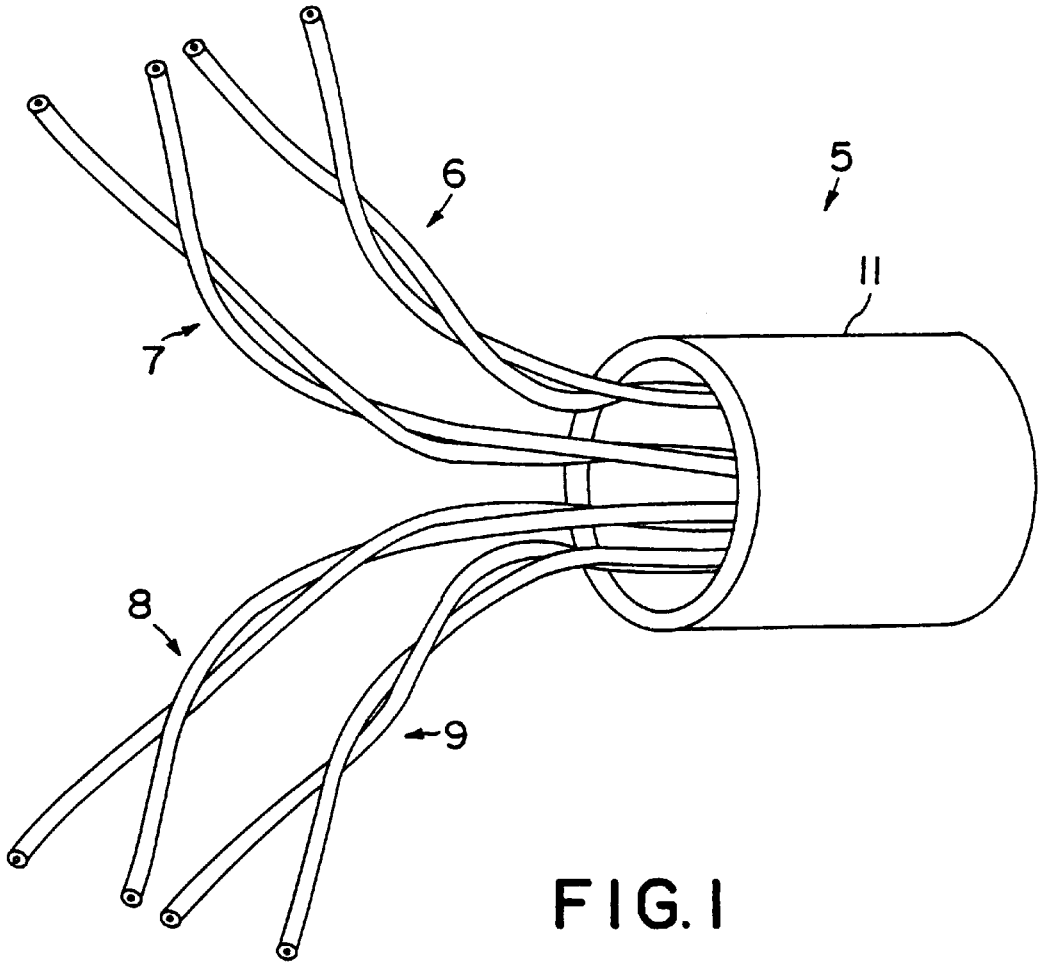
FIG. 1 is an elevation of a cable construction in accordance with the present invention with a portion of the outer jacket broken away for illustrative purposes.

As noted, FEP insulation with a low-smoke PVC jacket meets Category 5 electrical requirements and the applicable physical and burn property tests for plenum rated cable. The TIA/EIA 568-A standard sets forth the electrical requirements for Category 5 cable. In addition to other criteria, Category 5 cable must meet or exceed certain attenuation, return loss, and crosstalk requirements. For example, Category 5 cable must be configured such that any given conductor pair has an attenuation, in dB per 100 meters, measured at or corrected to a temperature of 20° C., within a frequency range of $f$=0.772 MHz to $f$=100 MHz, determined by the formula:

$$\mathrm{ATTN}(f) \leqq 1.967\,\mathrm{sqrt}(f)+0.023f+0.050/\mathrm{sqrt}(f).$$

In addition, Category 5 cable must be configured such that any given conductor pair has a structural return loss (SRL) in decibels, for a length of 100 meters or longer, within a frequency range of $f$=20 MHz to $f$=100 MHz, determined by the formula:

$$\mathrm{SRL}(f) \geqq 23-10\log(f/20).$$

For frequencies between 0.772 and 20 MHz, the SRL must be at least 23 dB. If the cable does not meet these (and other) performance criteria, then it may not be properly classified as Category 5 cable. The entire content of the TIA/EIA 568-A standard is incorporated by reference herein.

While the electrical and physical property requirements for Category 5 and higher cable could be met with other plastics such as polyolefins or modified polyolefins, the plenum burn requirements, such as the UL-910 plenum burn test, could not be met since polyolefins burn readily. If a polyolefin material was smoke suppressed and flame retarded, the ingredients necessary for flame protection would detract from the necessary electrical values of the polyolefin material, and would also detract from the physical property attributes of the material.

The CMP or plenum burn test is a severe test. The test takes place in a closed horizontal fixture or tunnel, with the ignition flame source being a 300,000 BTU/hour methane flame with a high heat flux, and a 240 foot/minute air draft. The test lasts 20 minutes, and the cable is stretched side to side across a 12 inch wide, 25 foot long wire mesh rack in the tunnel. To pass this test, flame spread must not exceed 5.0 feet after the initial 4.5 foot flame source; smoke generation must not exceed a peak optical density of 0.5 (33% light transmission); and the average optical density must not exceed 0.15 (70% light transmission). The purpose of this optical smoke density parameter is to allow a person trapped in a fire the ability to see exit signs as well as visually discern a route or means of escape. The entire content of the UL-910 standard is incorporated by reference herein.

FIG. 1 shows an elevation of a cable 5 in accordance with a preferred embodiment of the present invention. Cable 5 meets Category 5 electrical requirements and the applicable burn, smoke generation, and physical property requirements for plenum-rated cable without the use of FEP. Referring now to FIG. 1, there is shown cable 5, which is suitable for use in building plenums and the like. In the specific example shown in FIG. 1, the cable 5 is illustrated as having four twisted pairs of transmission media, referred to as twisted pairs and indicated by reference numerals 6, 7, 8 and 9, forming what is generally referred to as the cable core. In accordance with this embodiment of the invention, the twisted pairs 6–9 have a polyolefin primary insulation, which has good electrical characteristics even though it readily burns. In a specific embodiment of the present invention, a foam/skin high density polyethylene (HDPE) is used for the primary insulation, which has the requisite electrical characteristics for high frequency cable applications.

In order to provide the required resistance to burning, the cable 5 is provided with an outer jacket 11 which is highly resistant to burning. Thermoplastic halogenated polymers have been found to be suitable materials, particularly thermoplastic fluorocarbon polymers. In a specific embodiment of the invention, polyvinylidene fluoride (PVDF) has been found to be quite suitable in terms of providing adequate flame and burn resistance to meet the applicable standards.

A cable construction consisting of only the core of twisted pairs with polyolefin insulation surrounded by ajacket of conventionally extruded thermoplastic fluorocarbon polymer (such as solid PVDF) meets the applicable burn standards, but does not meet the high frequency electrical standards for Category 5 cable. Specifically, the less than optimal electrical characteristics of a conventionally manufactured fluorocarbon polymer jacket, and its proximity to the twisted pairs, degrade the cable's electrical characteristics.

In accordance with one embodiment of the present invention, a single outer foamed PVDF jacket 11 may be employed by cable 5 without any intermediate material between the cable core and the outer PVDF jacket 11. As shown in FIG. 1A, the inner surface of outer jacket 11 is adjacent and proximate to conductor core 15 and the outer surface of outer jacket 11 is exposed. The particular foam construction of the outer PVDF jacket 11 suitably enhances the electrical characteristics of the PVDF material, which typically exhibits very poor dielectric constant and dissipation factor values in a substantially solid or unfoamed state.

Although not shown in FIG. 1, cable 5 may include a shield located within outer jacket 11. Preferably, such a shield substantially surrounds the cable core and is configured to enhance the electrical performance of the cable core. For example, the shield may be configured to protect the cable core from extraneous RF or electromagnetic fields and signals. The shield may be formed from a metallic foil, such as aluminum or copper, and may be constructed according to any number of conventional methodologies. Such shields are known to those skilled in the art, and need not be described in detail herein.

FIG. 1A is a cross sectional view of cable 5 configured in accordance with a particularly preferred aspect of the present invention. The individual conductors 14 that form twisted pairs 6–9 are shown in a typical core arrangement proximate the center of cable 5. In accordance with the present invention, the composition and dimensions of the various materials are configured to enable cable 5 (and/or the individual twisted pairs) to pass the UL-910 plenum burn test, to meet the UL-444 physical requirements, and to meet the electrical specification for Category 5 cable. Prior art cables utilizing an HDPE primary insulation material and a PVDF outer jacket material do not meet each of these requirements.

A conductor core 15 (depicted in dashed lines) includes conductors 14, which are preferably arranged as four twisted pairs 6–9. In turn, the four twisted pairs 6–9 are twisted together into conductor core 15. In the preferred exemplary embodiment, conductor core 15 has a twist length of approximately six inches, i.e., the four twisted pairs 6–9 are twisted 360 degrees over a length of six inches. For the sake of convenience, conductor core 15 is depicted as having a circular periphery; it should be appreciated that conductor core 15 may be alternately configured in any suitable shape according to the specific application and/or according to the particular manufacturing technique. Indeed, in alternate embodiments, a core wrap material (not shown) may be utilized to physically bind or wrap conductors 14 together. Furthermore, although the twisted pairs 6–9 are shown spaced apart in FIG. 1A, a practical implementation of cable 5 may have conductors 14 arranged in a more compact manner. Cable 5 preferably includes an air gap 16 located between conductor core 15 and outer jacket 11. In the preferred embodiment, air gap 16 is formed during extrusion of outer jacket 11 (described in more detail below). The presence of air gap 16 enables the twisted pairs 6–9 (and, consequently, cable 5) to pass the strict Category 5 electrical requirements even though outer jacket 11 is formed from PVDF, which has very poor electrical characteristics.

The inventors have discovered that the use of air gap 16 enhances the electrical performance of cable 5 such that foaming of outer PVDF jacket 11 is not always necessary. In other words, a suitable Category 5 plenum cable may employ a solid PVDF outer jacket 11, air gap 16, and the foam/skin HDPE primary insulation. Such an arrangement need not employ an inner jacket or any intermediate material between outer jacket 11 and conductor core 15. Of course, the use of a foamed PVDF outer jacket 11 may be desirable for enhanced applications that require electrical performance above and beyond the minimum requirements of Category 5 cable.

Although the "wall" thickness of air gap 16 may vary from application to application, it is preferably between about 5 mils and 15 mils thick. In one preferred Category 5 plenum cable embodiment, air gap 16 is approximately 10 mils (0.010") thick. The preferred thickness of air gap 16 strikes a balance by enabling cable 5 to meet both the Category 5 electrical requirements and the UL-444 physical requirements. For example, the structural integrity of cable 5 may suffer if air gap 16 is too large, while the dimension of air gap 16 must be appropriately sized such that conductor core 15 remains in place within outer jacket 11. Furthermore, the maximum thickness of air gap 16 is limited for practical Category 5 cables, which must have an overall outer diameter of less than 0.25". On the other hand, the minimum thickness of air gap 16 is limited for practical Category 5 cables because as the thickness of air gap 16 decreases, the electrical characteristics of cable 5 degrade. Consequently, if the thickness of air gap 16 is too small, then cable 5 may not meet the requisite Category 5 electrical performance criteria.

Although air gap 16 is preferably formed during the extrusion of outer jacket 11 around conductor core 15, any suitable technique may be employed. In contrast to conventional communications cables in which the outer and/or intermediate jacket is snugly drawn down to surround the conductor core, air gap 16 is intentionally formed in cable 5 between outer jacket 11 and conductor core 15. Drawing down of intermediate or outer jackets is generally performed during the manufacture of prior art cables to ensure that the conductors remain in place and are adequately insulated; drawing down of extruded jackets is a relatively easy step that naturally occurs during the extrusion and quenching processes.

As described above, the preferred embodiment only includes conductor core 15, air gap 16, and outer jacket 11 (foamed or unfoamed PVDF). In accordance with one preferred embodiment, the wall thickness of outer jacket 11 is approximately 22 mils. This preferred thickness, along with air gap 16, enables cable 5 to be within the current maximum outer diameter for Category 5 cable (0.25"). The particular configuration of conductors 14, air gap 16, and outer jacket 11 (i.e., the specific composition of insulation and jacket materials and the specific dimensions of the cable components) enables cable 5 to meet the Category 5 electrical criteria while passing the UL-444 physical tests and the UL-910 plenum burn test.

Figure 2:
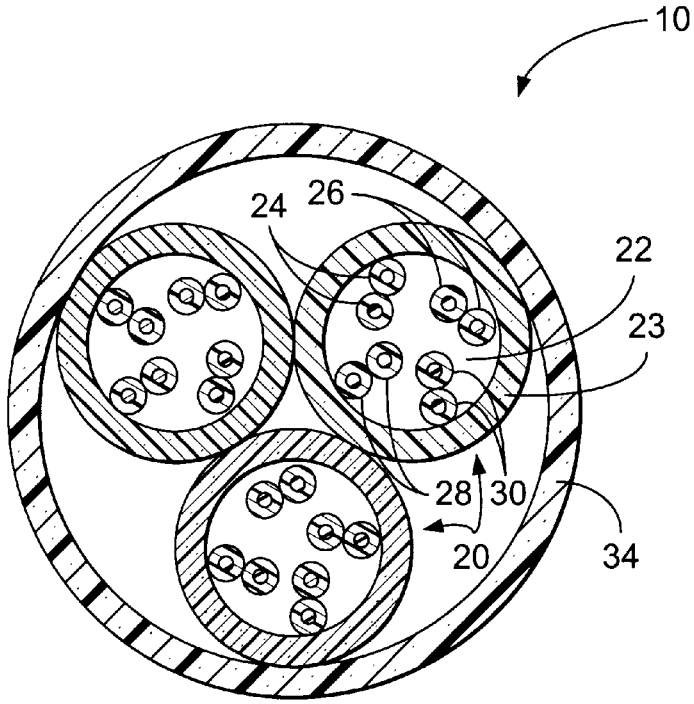
FIG. 2 is a cross sectional view of a cable construction in accordance with the present invention in which a plurality of cable cores are enclosed as a composite in an outer jacket.

Referring now to FIG. 2, there is shown a construction of a cable 10 in accordance with this invention, suitable for use in building plenums, and the like, e.g., indoor/outdoor rated cable, in which a plurality of cable cores are enclosed within a single foamed PVDF outer jacket. In FIG. 2, the cable 10 comprises one or more wrapped cables 20, each of which may include a core 22. The core 22 may be one which is suitable for use in data, computer, alarm, and other signaling networks as well as communications. The core 22 is the transmission medium and is shown in FIG. 2 as comprising one or more twisted wire pairs, the pairs of which are referred to in FIG. 2 by reference numerals 24, 26, 28 and 30. Cables which are used in plenums may include 25 or more conductor pairs, although some cables include as few as six, four, two or even a single conductor pair such as shown in FIG. 1. In the exemplary embodiment shown in FIG. 2, each of the cores 22 comprise four twisted conductor pairs, identified in FIG. 2 with reference numerals 24, 26, 28 and 30.

As shown in FIG. 2, each of the cables 20 preferably utilizes a foamed PVDF inner jacket configured identified by reference numeral 23. The inner jacket 23 may be configured as described more fully hereafter. Those skilled in the art will appreciate that the inner jacket 23 is not a requirement of the present invention, and that any suitable wrapping element known to those skilled in the art may be employed by cable 10. Furthermore, the particular material utilized as the inner jacket 23 may be selected to enhance the electrical and/or physical properties of cable 10. As described above in connection with FIG. 1A, one or more of the individual cores 22 may include an air gap formed between the outer periphery of the conductors and the inner surface of the associated inner jacket 23. Such an air gap may be utilized to obtain the benefits described above.

Again, if a suitably configured air gap is employed, then the foamed PVDF jacketing may not be a necessity.

As also shown in FIG. 2, a plurality of the cables 20 are disposed within an outer jacket 34 in this embodiment. In FIG. 2, three cables 20 are shown as enclosed in an outer jacket 34, although the invention is equally applicable to there only being one cable enclosed by an outer jacket (as shown in FIG. 1) and for there being more or less than three cables 20 disposed within the outer jacket 34. Cable 10 may also utilize an air gap (not specifically shown) located between the outer periphery of the individual cables 20 and outer jacket 34.

In accordance with one embodiment of this invention, each of the cables 20 may be provided with a substantially flame retardant core wrap rather than inner PVDF jacket 23. Such a construction may be desirable for a cable arrangement having a large number of insulated pairs, e.g., more than 12. A flame retardant core wrap may be employed to ensure that the cable arrangement satisfies the associated plenum burn requirements.

Figure 3:
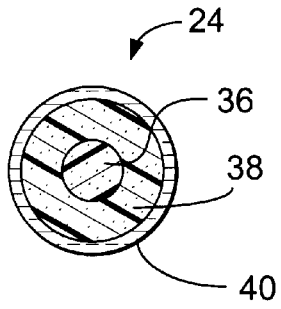
FIG. 3 is a cross-section of one of the conductors in a twisted wire pair of the cable shown in FIG. 2.

FIG. 3 is a cross-section of one of the conductors in any one of the twisted pairs described herein, such as twisted pair 24. The conductor or transmission medium 24 includes a conductor 36 surrounded by an insulating material 38. The insulating material 38 may have a skin portion indicated by reference numeral 40.

In accordance with a preferred embodiment of the invention, the primary insulation surrounding conductor 36 in each wire in the twisted wire pairs, such as wire pair 24, is a foam/skin polyolefin dual extruded insulation, which is acceptable for Category 5 electrical characteristics. The reasons for using a foam/skin insulation, such as foam 38 with skin 40, in addition to achieving improved electrical properties, is to effectively decrease the amount of polyolefin material available to burn.

It is important to keep the foam/skin insulation material pure, with no fillers, such that this insulation can match or exceed the electrical properties of FEP. For example, FEP has a dielectric constant of 2.1, with a dissipation factor of 0.0001; in accordance with a specific embodiment of the invention described herein, the insulation is a pure foam/skin HDPE having a dielectric constant of 1.8, with an equivalent dissipation factor of 0.0001. With this configuration, the velocity of propagation is even improved with the foam/skin at approximately 78% as opposed to approximately 75% for FEP. By comparison, a flame retardant polyolefin with fillers would have a velocity of propagation of 67%. Also, a 2×2 cable (two pairs of flame retardant polyolefins plus two pairs of FEP) would encounter velocity of propagation skew problems, which is the difference in the distribution of electrical flow between the two insulation types. There are no skew problems with the pure foam/skin HDPE. Velocity of propagation considerations and skew factors are discussed more fully hereafter.

In accordance with one specific embodiment of the present invention, the primary insulation is dual extruded, with foam insulation 38 being a HDPE. A suitable material is one produced and available from Union Carbide Corporation identified as DGDB-1351NT, although an equivalent suitable for mechanical foaming may be used. In accordance with the specific embodiment of the invention, the skin portion 40 of wire 24 is also a HDPE produced by Union Carbide Corporation and available therefrom and identified as DGDM-3364 NT. In such an insulation construction, the polyolefin skin 40 has to be of adequate thickness to protect the overall foam/skin primary insulation from crushing during twist. The degree of foaming, the foam thickness, and the skin thickness are dependent upon compliance with UL-444 physical property testing requirements. The UL-444 standard sets forth a number of physical characteristics and tests for communications cables. The entire content of the UL-444 standard is incorporated by reference herein.

To enable the cables to meet the various electrical, physical, and burn criteria, the wall thickness of foam insulation 38 is preferably less than 0.010 inches, while the wall thickness of skin insulation 40 is preferably less than 0.008 inches. In accordance with one particularly suitable embodiment, the foamed insulating material 38 has a thickness of 0.0060 inches, and the skin insulation 40 has a thickness of 0.0022 inches.

In accordance with a specific embodiment of the invention, each conductor 36 has a diameter within the range of 0.0208 to 0.0218 inches, which is near the upper maximum diameter allowable for 24 gauge wire. The use of 24 gauge wire is preferred for purposes of meeting the Category 5 requirements (although the Category 5 standard also allows the use of 22 gauge wire). In contrast to conventional manufacturing techniques that utilize smaller diameter conductors to reduce costs, the use of "oversized" conductors 36 in the context of the present invention is desirable to meet the electrical requirements of Category 5, e.g., the attenuation and return loss criteria. In the preferred embodiment, conductors 36 have a diameter of approximately 0.0212 inches. In contrast, prior art plenum cables with FEP insulation utilize conductors having diameters between 0.0198 and 0.0201 inches.

It should be appreciated that very small variations in the diameter of conductor 36, the thickness of air gap 16 (FIG. 1A), the thickness of outer jacket 11 (FIG. 1A), the thickness of foam insulation 38, or the thickness of skin insulation 40 may contribute to the electrical performance of the finished cable. Consequently, the selection of these (and other) dimensions is important in the context of the present invention.

As previously mentioned, the primary insulation of the transmission media is preferably a foamed/skin construction of HDPE. One material which was found to be quite suitable in accordance with the invention is a polyethylene material known as DGDB-1351NT, and available under that designation from Union Carbide. When this material is foamed and dual extruded with a skin, DGDM 3364 NT also produced by Union Carbide Corporation, it has a dielectric constant at 1 MHz of 1.80, a dissipation factor at 1 MHz of 0.0001, and an LOI of 17 percent. LOI refers to the limiting oxygen index, the percent of oxygen in air at which the sample burns completely. The specific gravity of this material is 0.945, but this material does not char, and hence needs to be protected by additional materials to meet the burn test, in accordance with and as provided by this invention.

As described above, the outer jacket 11 or 34 in accordance with this invention may be a foamed halogenated polymer, and can be a foamed PVDF material. One PVDF material which has proved to be extremely suitable is known as SOLEF 31508, available from Solvay Polymers, Inc. In an unfoamed state, this material has a dielectric constant of 8.40 at 1 MHz, a dissipation factor of 0.1850 at 1 MHz, and an LOI of 100 percent (the ideal LOI). The specific gravity of the unfoamed material is 1.78, and it exhibits excellent char formation.

It should be appreciated that other materials, such as a PVDF alloy, may also be suitable for outer jackets 11 or 34. One such alloy that has been employed in a dual jacket embodiment is available from Solvay and identified as SOLEF 70109-X003. The dielectric constant of this material at 1 MHz is 5.20, the dissipation factor at 1 MHz is 0.1250, and the LOI is 65 percent. The specific gravity of this material is 1.64, and its char formation is excellent. The inventors contemplate that this and other PVDF alloys, including other suitable PVDF materials available from other commercial suppliers, may be foamed in accordance with the present invention.

During manufacturing of the preferred cable construction, an extrusion tool may be employed to ensure that outer jackets 11 and 34 are properly fabricated to meet physical and electrical requirements. With the exception of the extrusion tool having a die/core tube Land length of one to two inches, such extrusion tools and related processes are known to those skilled in the art and, therefore, need not be described in detail herein. In accordance with an exemplary manufacturing technique, a quench water trough is placed within approximately three inches from the extruder head to thereby quench the tube extruded jacket during draw-down. In this manner, outer jacket 11, 34 is quenched immediately following extrusion to limit draw-down of outer jacket 11, 34 upon the conductors. In contrast, prior art manufacturing techniques may not quench the extruded outer jacket until well after it has completely drawn down around the conductor core. For example, in accordance with prior art techniques (that require complete draw down), the quench water trough may be placed as far as three feet from the extruder head.

In addition, air (or another suitable gas) may be injected through the extruder head during draw-down to expand the jackets 11 and 34 and maintain their substantially round cross sectional shape throughout the extrusion process. The air injection forms air gap 16 (FIG. 1A) and the immediate water quench preserves air gap 16 in the completed cable. The use of such air injection prevents the PVDF outer jacket 11, 34 from collapsing around the conductor core during manufacturing, as experienced during conventional extrusion processes.

The specific air pressure applied during extrusion to form air gap 16, the line speed of the core passing through the extruder, the extruder speed, the position of the quench trough, and other manufacturing parameters, can affect the thickness of outer jacket 11, 34 and/or the thickness of air gap 16. Accordingly, these parameters may be suitably selected such that the preferred dimensions described above are realized. In accordance with one current manufacturing technique, the air pressure utilized to form air gap 16 is approximately 5 psi, and the line speed is approximately 600 feet per minute.

As described above, foaming of outer PVDF jackets 11 and 34 is optional for embodiments that include a suitable air gap 16 between conductor core 15 and outer jacket 11, 34. However, a foamed PVDF outerjacket 11, 34 may still be desirable to enable the cable to operate as an enhanced Category 5 cable that exceeds the electrical requirements of Category 5 by a noticeable margin. As such, in accordance with one preferred aspect of the present invention, outer jackets 11 and 34 are formed by a chemical foaming process that utilizes a chemical foaming agent. In one exemplary embodiment, the outer jacket material is formed by introducing a chemical foaming agent to the PVDF (or other suitable material). Such chemical foaming techniques are known to those skilled in the material sciences and cable manufacturing arts. Of course, the specific amount of foaming agent may be varied depending upon the desired electrical and physical characteristics of the end product, the particular manufacturing processes and equipment used, the particular outer jacket material, or other application-specific variables.

In accordance with a second embodiment of the present invention, outer jackets 11 and 34 are formed by gas injection, where the gas injected during the foaming process is preferably nitrogen. Such gas injection processes are known to those skilled in the art and, therefore, are not described in detail herein. In accordance with one exemplary embodiment, the amount of foaming agent/plastic carrier employed to electrically enhance the PVDF jacket material falls within the range of approximately 1 to 10 percent by weight, and within a preferred range of about 3 to 8 percent by weight. The amount of foaming is preferably selected such that the dielectric constant of outer jackets 11, 34 is reduced to an acceptable value while maintaining the physical integrity of the finished cable. For example, although an excessively foamed outer jacket may have excellent electrical qualities, the UL-444 tensile strength and crush resistance requirements may not be met.

In accordance with another exemplary embodiment, outer jackets 11 and 34 are foamed to an expansion within the range of 5 to 30 percent, and within a preferred range of about 5 to 15 percent. In the context of this specification, the percent of expansion refers to the change in the specific gravity of the solid versus the foamed outer jacket material. The percent of expansion may be calculated by physically measuring the weight and dimensions of a sample portion of the foamed PVDF outer jacket and comparing the weight to a comparably sized amount of solid PVDF.

In the preferred embodiment, outer jacket 11, 34 has a thickness within the range of 15 to 40 mils. The foamed PVDF outer jacket 11, 34 is preferably about 22 mils thick. In the preferred embodiment, the PVDF outer jacket 11, 34 is foamed from its inner surface to its outer surface with small, discrete cells. The uniformity and size of the foam cells suitably enhances the electrical characteristics of cables 5, 11. It should be noted that extrusion tools may be configured to impart a smooth (but not a skin) outer surface to cables 5, 11. For example, the die tip of an exemplary extrusion tool may be heated to smooth the outer surface of the jacket after it has been foamed. In addition, the die Land length may be configured to suitably impose a higher pressure drop (and correspondingly higher foaming) as the PVDF material exits the die tip. In a preferred tooling embodiment, a die Land length of greater than one inch is utilized.

Those skilled in the art will appreciate that the specific thickness and surface texture of outer jacket 11, 34 may vary depending upon the particular electrical and/or physical requirements of the cable, e.g., the requirements for a Category 5 plenum-rated cable. For example, one preferred embodiment of the present invention incorporates conductors 14, air gap 16, and outer jacket 11 (FIG. 1A) configured such that electrical performance of the cable is in compliance with TIA/EIA 568A Category 5 cable standards. The particular amount of foaming and the specific composition of outer jacket may be suitably selected to ensure that the physical and burn characteristics of the cable meet all of the relevant requirements, e.g., as set forth in UL-444 and UL-910.

It should be appreciated that the use of a single outer jacket may reduce the manufacturing time and costs associated with a Category 5 plenum cable, e.g., cable 5. The foamed PVDF construction of outer jacket 11 enables cable 5 to pass the required UL burn tests and the Category 5 electrical tests without the need for an inner or intermediate jacket or a core wrap. Alternatively, a solid PVDF outer jacket 11 may be suitable in a cable construction having an appropriately configured air gap 16. Although the single outer jacket configuration is preferred, in accordance with one aspect of the invention the core can be wrapped with an inner jacket of foamed PVDF material to provide further burn and smoke protection and/or to enhance the electrical performance of the cable.

A number of experimental cables were fabricated utilizing the materials set forth previously for insulation construction and outer cable jackets. The experimental cables which passed the UL-910 plenum burn test at an independent laboratory along with the relevant test data, are set forth in Table 1 below:

TABLE 1

UL-910 Steiner Tunnel Burn Results
Foamed PVDF Single Jacket Cable

| Cable Construction (Requirements) | Jacket Thickness (mils) | Peak Optical Density (≦0.5) | Average Optical Density (≦0.15) | Flame Spread (ft) (≦5 ft) |
|---|---|---|---|---|
| Cable #1–4 Pairs | 24 | | | |
| Burn 1 | | 0.19 | 0.07 | 2.5 |
| Burn 2 | | 0.25 | 0.07 | 3.5 |
| Cable #2–4 Pairs | 22 | | | |
| Burn 1 | | 0.17 | 0.05 | 3.5 |
| Burn 2 | | 0.20 | 0.06 | 4.0 |

All of the above listed cables passed the plenum burn test as indicated, and also passed the Category 5 electrical requirements, as well as the UL-444 physical property test requirements.

Although an initial objective in accordance with the present invention focused on developing a cable construction that met the performance of existing cable using FEP insulation, it has been unexpectedly found that cable constructed in accordance with the principles of this invention actually exceeds the performance of FEP insulated cable. In the prior art, in addition to cables utilizing, for example, four twisted pair, all having FEP insulation, there have been constructions using a combination of insulation materials. These combination insulation constructions have been aimed at dealing with the shortage of FEP material relative to the demand for high category cables. For example, one prior art construction utilized a cable containing three twisted pair of FEP insulated conductors with one twisted pair of olefin insulated conductors. Another prior art construction utilized a cable containing two twisted pair of FEP insulated conductors, and two twisted pair of olefin conductors.

When plenum cables are subjected to increased temperatures, the electrical characteristics of the cable (e.g., attenuation, structural return loss, and cross-talk) may drift by an undesirable amount. Indeed, Category 5 cables must pass elevated temperature attenuation requirements at 40° C. and at 60° C.; in accordance with current standards, the attenuation of Category 5 cables must be less than about 67.0 dB at room temperature, less than about 72.3 dB at 40° C., and less than about 77.7 dB at 60° C. Although a cable utilizing FEP insulation and a low-smoke PVC jacket may meet these elevated temperature attenuation requirements, it may not remain electrically stable at much higher temperatures, e.g., greater than 100° C.

In accordance with the present invention, outer jackets 11 and 34 enable cables 5 and 10 to exhibit electrical stability (for purposes of performance tests) from room temperature to a temperature exceeding 60° C. In an exemplary embodiment, cables 5 and 10 are electrically stable to at least about 121° C., which is approximately the highest temperature that may be reached within a plenum. For example, although the attenuation of Category 5 cables must be less than about 94 dB at 121° C., a prototype cable constructed in accordance with the present invention exhibited attenuation less than 70.0 dB at 121° C. In addition to the enhanced attenuation performance, cables 5 and 10 also meet or exceed the electrical performance requirements associated with structural return loss and cross-talk from room temperature to 121° C. In contrast, prior art cables that employ low-smoke PVC outer jackets are not electrically stable at high temperatures, e.g., temperatures exceeding 90° C. Indeed, the attenuation of such prior art cables typically continues to increase as the temperature increases.

In response to increased fire safety concerns and the long-term electrical performance of plenum rated cables, cables constructed in accordance with the present invention are subjected to rigorous thermal testing to ensure that the cables exceed long-term fire safety standards while maintaining Category 5 compliance. Briefly, cables configured with an HDPE primary conductor insulation and a PVDF outer jacket (preferably foamed) are aged at 121° C. and subsequently subjected to the UL-910 plenum burn test. The present inventors are unaware of any non-FEP based Category 5 cable that can pass this rigorous battalion of tests.

The aging process exposes a length (e.g., 4,000 feet) of cable 5 to a controlled temperature above 100° C. (e.g., at 121° C.) for at least 30 continuous days (preferably, for 60 continuous days). As mentioned above, 121° C. is the highest practical temperature that plenum cables may be exposed to in real-world installations. The continuous high temperature aging simulates the long term environmental effects associated with an actual plenum use. The thermally aged cable 5 is then subjected to the UL-910 plenum burn test, as described in more detail herein. The peak optical density (average for two burns) was only 0.32, which is less than the UL-910 maximum of 0.50. In comparison, the peak optical density (average for two burns) for a similar unaged control cable was 0.26.

Prior art cables that employ low-smoke PVC jackets do not pass the UL-910 plenum burn test after high temperature aging because such jacket materials include a large number (possibly exceeding 15) of additives, fillers, and/or flame retardants. When exposed to high temperatures, these additives, fillers, and flame retardants can leech from the jacket material, thus altering the flame/smoke resistance and electrical characteristics of the cable. In contrast, the PVDF outer jacket material employed by cable 5 is substantially resistant to high temperature aging, i.e., its flame and smoke resistant qualities do not considerably degrade. Furthermore, the electrical characteristics of cable 5 are maintained due, in part, to the long term thermal aging of the HDPE primary insulation material.

In all cables intended for high frequency transmission applications, the velocity of signal propagation (which should be as high as possible) is extremely important, as is the allowable skew. Skew refers to variations among twisted pair in a single cable of the velocity of propagation or other characteristics, and should be as small as possible to minimize data distortion. Table 2 represents the results of measurements of characteristics of a 4 pair FEP cable construction and a 4 pair foam/skin HDPE cable construction in accordance with the present invention. In Table 2, the theoretical velocity of propagation is expressed in percent of the speed of light, and the delay is expressed in nanoseconds over a 100 meter cable run. The theoretical velocity of propagation is related to the effective dielectric constant. The skew percent is determined by the ratio between the worst twisted pair characteristics and the best twisted pair characteristics. The references to BRN, GRN, BLU and ORN, are simply references to particular colors of twisted pair in a standard 4 twisted pair color standard.

TABLE 2

| Conductor Characteristics | | | | |
|---|---|---|---|---|
| Cable Construction | Insulation | Color | Effective Dielectric Constant | Theoretical Velocity of Propagation (%) |
| 4 pr. FEP | FEP | BRN | 1.74 | 75.80 |
| | FEP | GRN | 1.76 | 75.40 |
| | FEP | BLU | 1.81 | 74.30 |
| | FEP | ORN | 1.83 | 73.90 |
| | | Average | 1.79 | 74.90 |
| | | Skew | 4.80% | 2.80% |
| 4 pr. foam/skin | F/S | BRN | 1.59 | 79.20 |
| | F/S | GRN | 1.61 | 78.80 |
| | F/S | BLU | 1.64 | 77.90 |
| | F/S | ORN | 1.66 | 77.50 |
| | | Average | 1.63 | 78.35 |
| | | Skew | 4.40% | 2.20% |

As shown by the above table, the dielectric constant, velocity of propagation, and delay time for cable constructed with foam/skin insulation in accordance with the present invention are all significantly better than FEP-only insulated cable. The skew for the cable of this invention is also significantly better than for FEP-only insulated cable. Such a cable construction is indeed suitable for high frequency and ATM applications.

Although the Category 5 plenum cables described above are suitable for many applications, a given production lot may only marginally meet the required electrical criteria; this trend is due in large part to the motivation to keep manufacturing and design costs low. There remains a need for enhanced Category 5 plenum cables that exceed the electrical requirements of Category 5 cable (to reduce the failure rate of Category 5 plenum cables and/or to meet the needs of newer applications that require very high performance cabling. An alternate embodiment of the present invention provides such enhanced Category 5 performance. For the sake of convenience, the following description refers to the "enhanced" embodiment of the present invention. It should be noted that the various features described herein are not limited to any particular cable embodiment, whether classified as a Category 5 cable or an enhanced Category 5 cable.

In accordance with a preferred aspect of the present invention, each of the twisted pairs 6–9 (FIG. 1A) is formed such that it has a specific twist length. Twist length refers to the distance over which the given pair is twisted through one revolution; a tighter twisting corresponds to a shorter twist length, while a looser twisting corresponds to a longer twist length. The particular twist lengths are associated with the orientation of the twisted pairs 6–9 (relative to one another) and the physical properties of the foam/skin HDPE insulation material. The preferred twist lengths enable cable 5 to exceed the electrical requirements of Category 5 cable by an appreciable margin. Such enhanced performance enables cable 5 to be used in high frequency applications that demand very low noise and distortion levels. Furthermore, practical cables utilizing this preferred twist length scheme exhibit a high pass rate during Category 5 compliance testing. The higher pass rate results in increased profitability.

With brief reference to FIG. 1, twisted pairs 6–9 are depicted in an exposed manner. Those skilled in the art will appreciate that the difference in twist lengths may be imperceptible at the scale used in FIG. 1. Nonetheless, each of twisted pairs 6–9 preferably has a different twist length. Referring again to FIG. 1A, twisted pairs 6–9 are preferably arranged such that, with respect to the cross sectional view, twisted pair 6 (i.e., Pair #1) generally opposes twisted pair 7 (i.e., Pair #2). Similarly, twisted pair 8 (i.e., Pair #3) generally opposes twisted pair 9 (i.e., Pair #4). This preferred arrangement is maintained throughout the length of conductor core 15, regardless of the twisting associated with conductor core 15. In accordance with the present invention, twisted pair 6 has a twist length in the range of 0.59" to 0.63", twisted pair 7 has a twist length in the range of 0.53" to 0.57", twisted pair 8 has a twist length in the range of 0.67" to 0.71", and twisted pair 9 has a twist length in the range of 0.76" to 0.80". The approximate twist lengths for a preferred exemplary embodiment are: 0.61" for twisted pair 6; 0.55" for twisted pair 7; 0.69" for twisted pair 8; and 0.78" for twisted pair 9.

The use of shorter twist lengths is desirable to reduce the amount of near end cross talk (NEXT) between two neighboring twisted pairs. As set forth in the TIA/EIA 568A Standard for Category 5 cables, the minimum NEXT loss, in dB, for any pair combination at room temperature must be greater than the value determined using the formula:

$$\mathrm{NEXT}(f) \geqq 64 - 15 \log(f/0.772).$$

The 64 dB value in the above formula is the minimum NEXT loss for Category 5 cable taken at 0.772 MHz. In accordance with this formula, the minimum NEXT loss for Category 5 cable taken at 100 MHz is 32.3 dB. Although increasingly shorter twist lengths in the twisted pairs may further reduce the amount of NEXT, the physical properties of HDPE foam insulation 38 place practical limitations on how short the twist length can be. In particular, if the twist length is too short, then the foam insulation 38 may become crushed or otherwise distorted, which adversely affects the SRL characteristics of the cable. As described above, Category 5 cables must also meet certain SRL requirements for frequencies up to 100 MHz. Thus, the selection of the preferred twist lengths reduces the NEXT associated with cable 5 while preserving or improving the SRL characteristics of cable 5 (relative to other embodiments that utilize longer twist lengths).

As described above, an enhanced Category 5 cable may utilize specific twist lengths for the twisted pairs that form conductor core 15 (FIG. 1A). In addition to the use of air gap 16, these preferred twist lengths contribute to the enhanced electrical performance of cables configured in accordance with the present invention, e.g., cable 5. For example, cable 5 may be suitably configured such that its associated NEXT, power sum, SRL, and attenuation to cross talk ratio (ACR) values appreciably exceed the minimum electrical requirements of Category 5 cable. Each of these electrical characteristics are discussed in more detail below.

FIGS. 4A–4F are graphs of experimental NEXT test results associated with a four-pair cable constructed in accordance with the present invention. Each of FIGS. 4A–4F represent the NEXT associated with a particular two-pair combination. The test cable utilized the preferred twist lengths described above for the four twisted pairs. The NEXT testing was conducted in accordance with conventional procedures; such procedures are well known and will not be described in detail herein. The swept frequency NEXT tests associated with FIGS. 4A–4F were all performed for a 1000 foot length of test cable, at a temperature of 68° F. Each of the graphs corresponds to the NEXT measured on a given receive pair in response to a signal impressed on a different transmit pair. The straight line on each of the graphs represents the minimum acceptable NEXT loss for Category 5 cables. FIG. 4G is a table showing a number of experimental data points corresponding to the graphs of FIGS. 4A–4F.

Figure 4A:
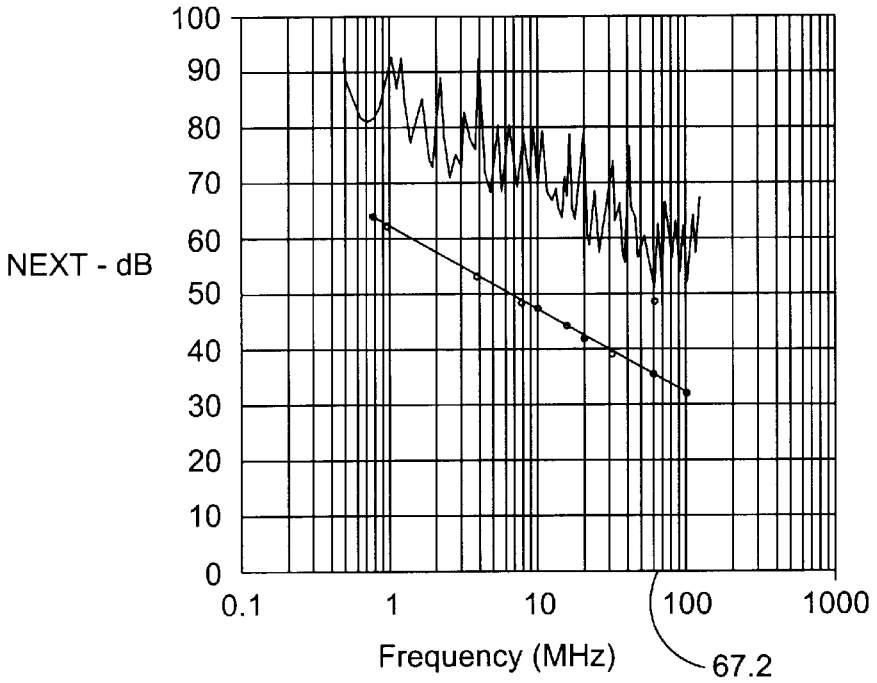
FIGS. 4A–4F are graphs of experimental near end crosstalk (NEXT) test results for a cable configured in accordance with the present invention.
Figure 4B:
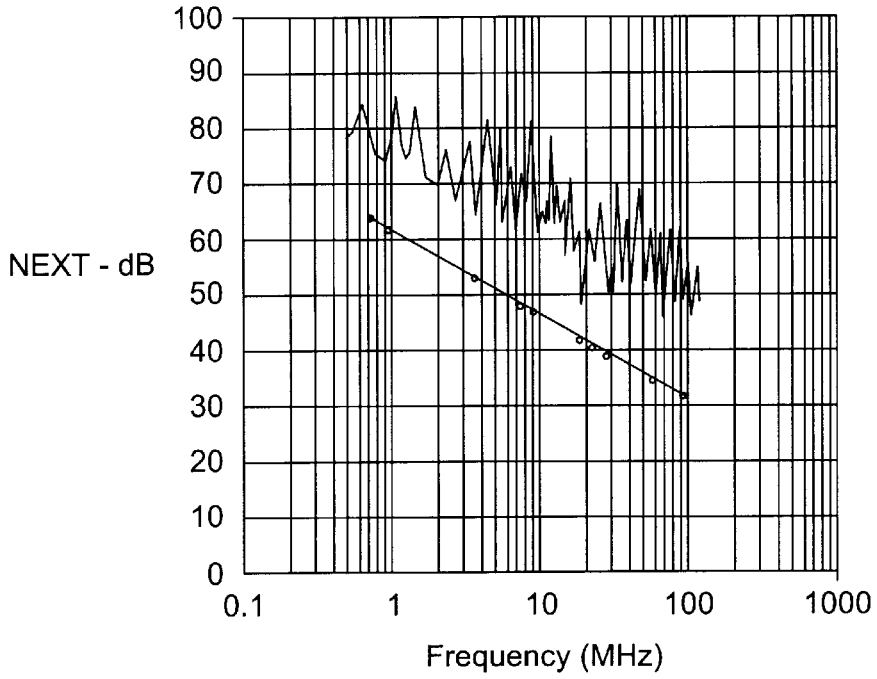
Figure 4C:
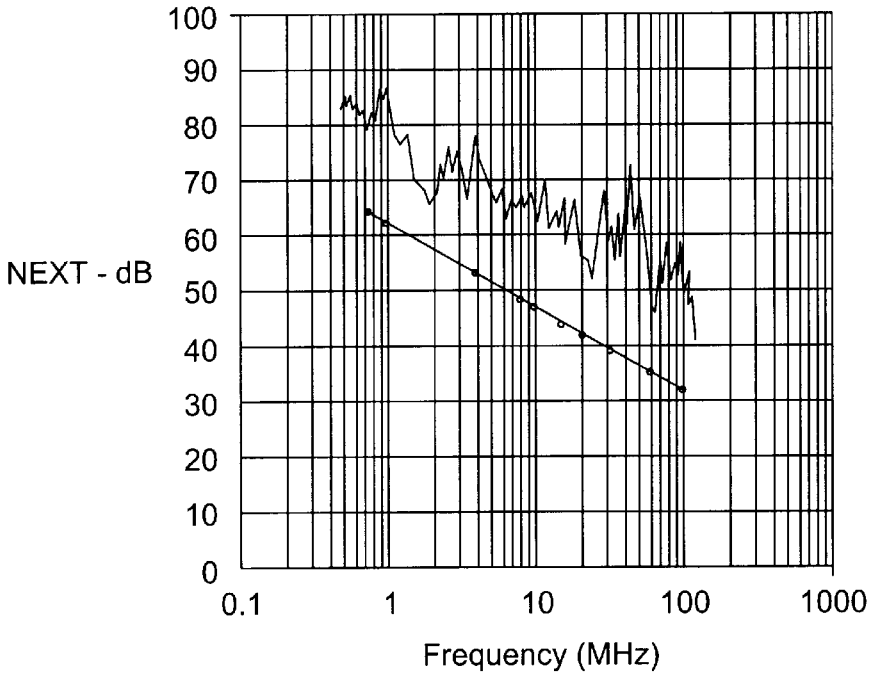
Figure 4D:
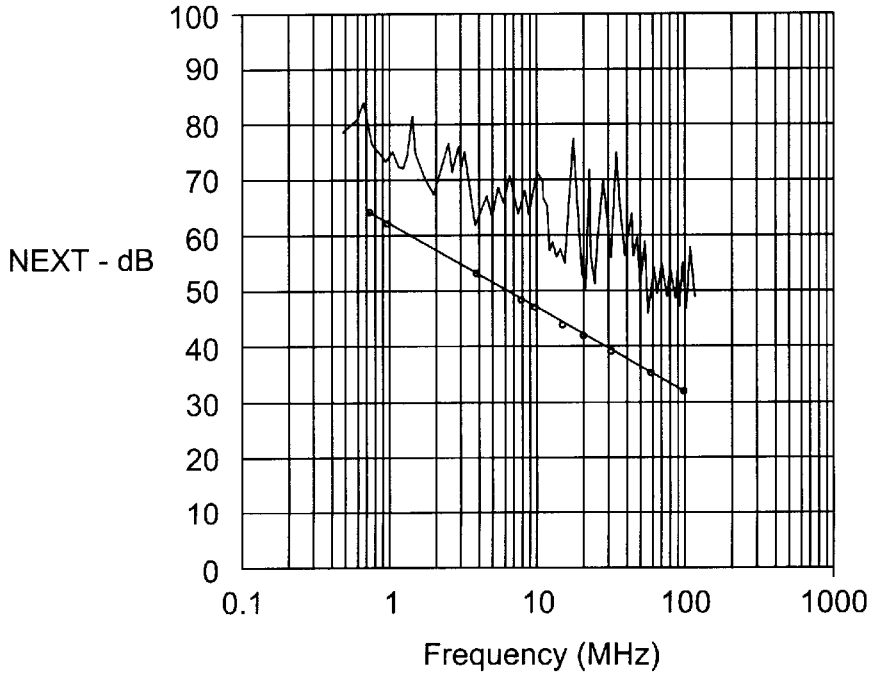
Figure 4E:
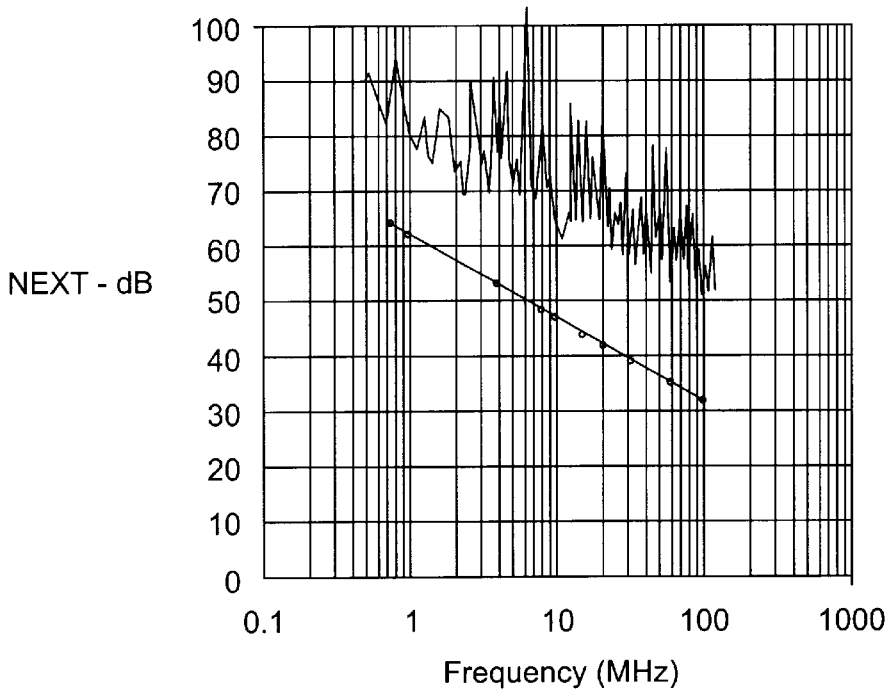
Figure 4F:
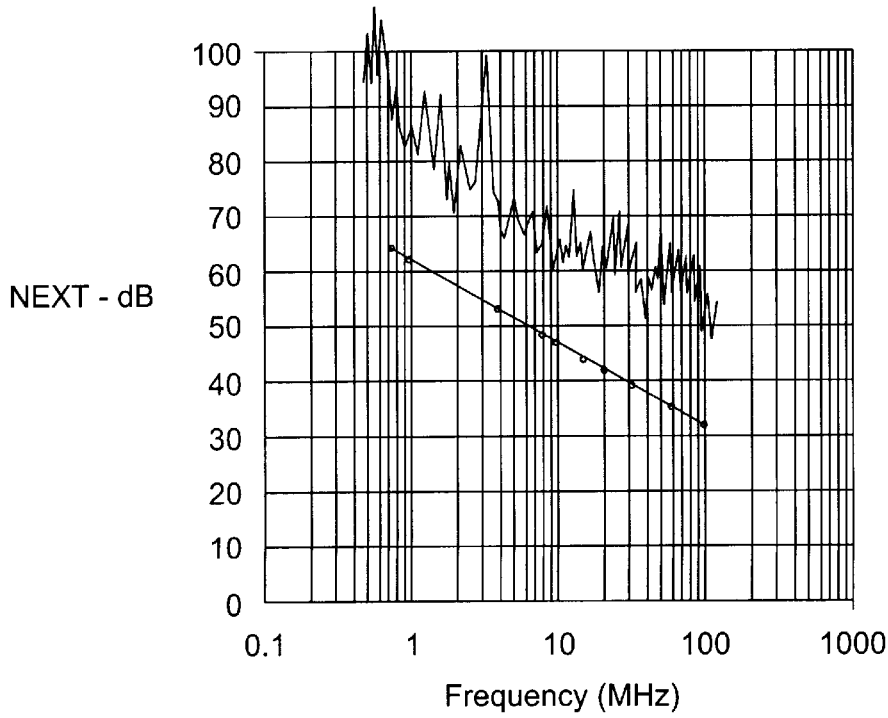

With reference to FIG. 4A, the worst case NEXT loss for the test condition of Pair #1 to Pair #2 was measured at a frequency of 67.2 MHz. At this frequency, the improvement over the Category 5 baseline was 13.4 dB. Consequently, the margin of improvement at all other test frequencies exceeded 13.4 dB. Similarly, the margin of improvement over the Category 5 requirement for the remaining test conditions were: Pair #1 to Pair #3—10.0 dB measured at 3.8 MHz; Pair #1 to Pair #4—8.3 dB measured at 2.0 MHz; Pair #2 to Pair #3—6.8 dB measured at 58.5 MHz; Pair #2 to Pair #4—13.0 dB measured at 2.5 MHz; and Pair #3 to Pair #4—12.4 dB measured at 37.1 MHz.

Notably, at the highest test frequency of 100 MHz, the margins of improvement over the Category 5 requirement were: Pair #1 to Pair #2—25.0 dB; Pair #1 to Pair #3—14.3 dB; Pair #1 to Pair #4—20.0 dB; Pair #2 to Pair #3—22.6 dB; Pair #2 to Pair #4—20.7 dB; and Pair #3 to Pair #4—25.0. Repeated testing of this cable construction confirms that, at 100 MHz, the margin of improvement over the Category 5 NEXT requirement, for the worst case pair, is within the range of 10 dB to 15 dB. Typically, this margin of improvement is at least 12 dB at 100 MHz. Accordingly, the minimum NEXT loss at 100 MHz, for a cable constructed in accordance with the present invention, is 42.3 dB. The 42.3 dB value can be derived from the Category 5 NEXT formula set forth above, with a 10 dB margin added.

Figure 5A:
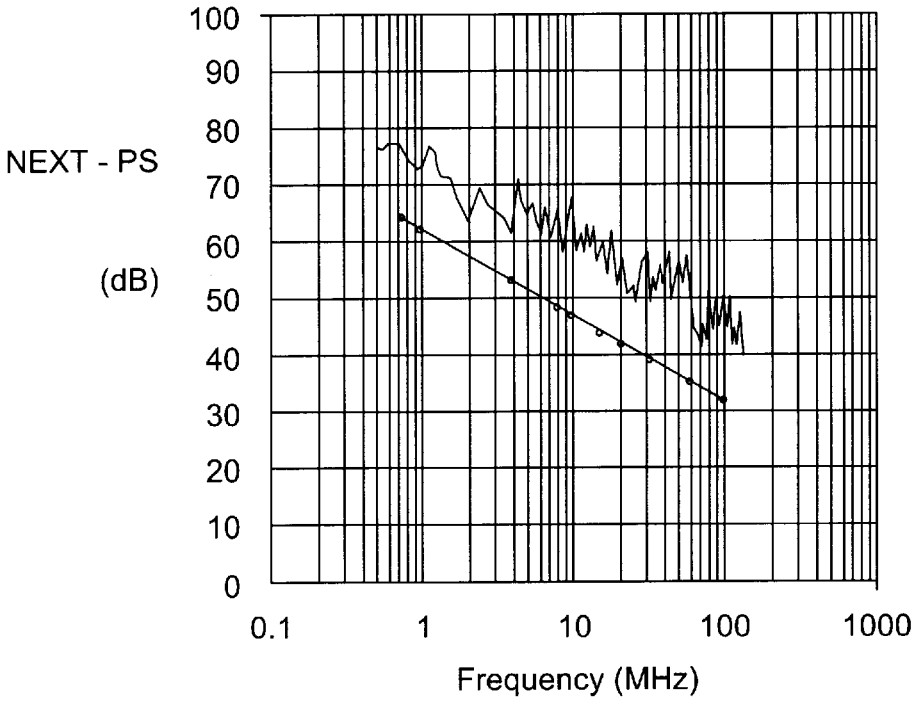
FIGS. 5A–5D are graphs of experimental NEXT power sum test results for a cable configured in accordance with the present invention.
Figure 5B:
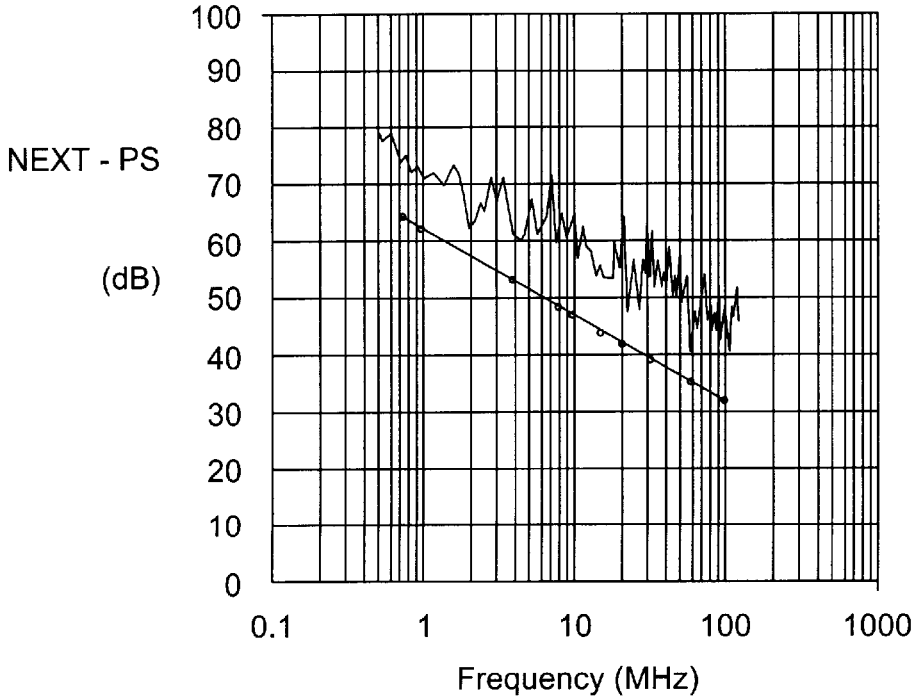
Figure 5C:
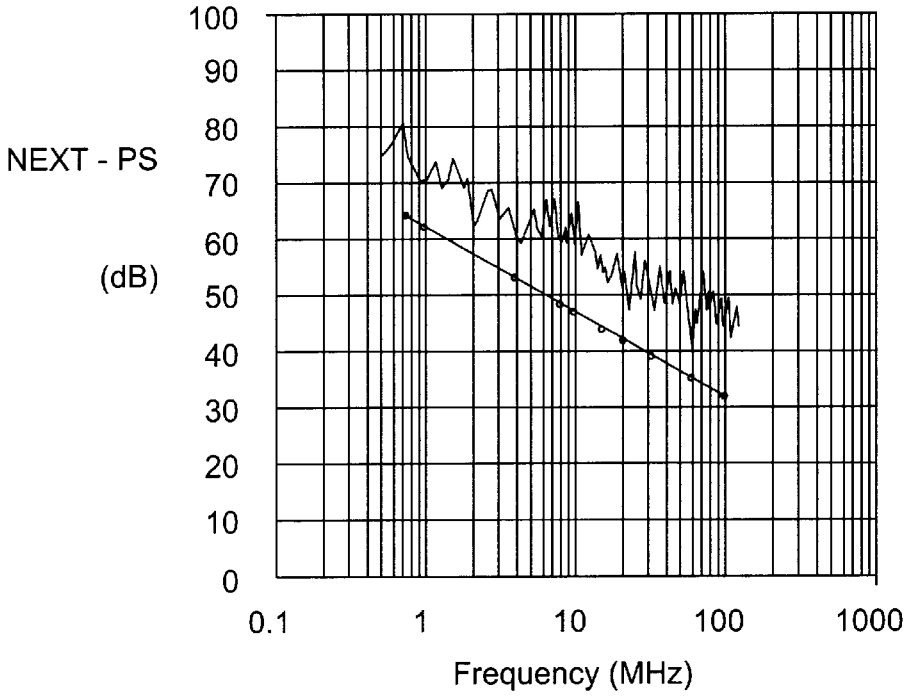
Figure 5D:
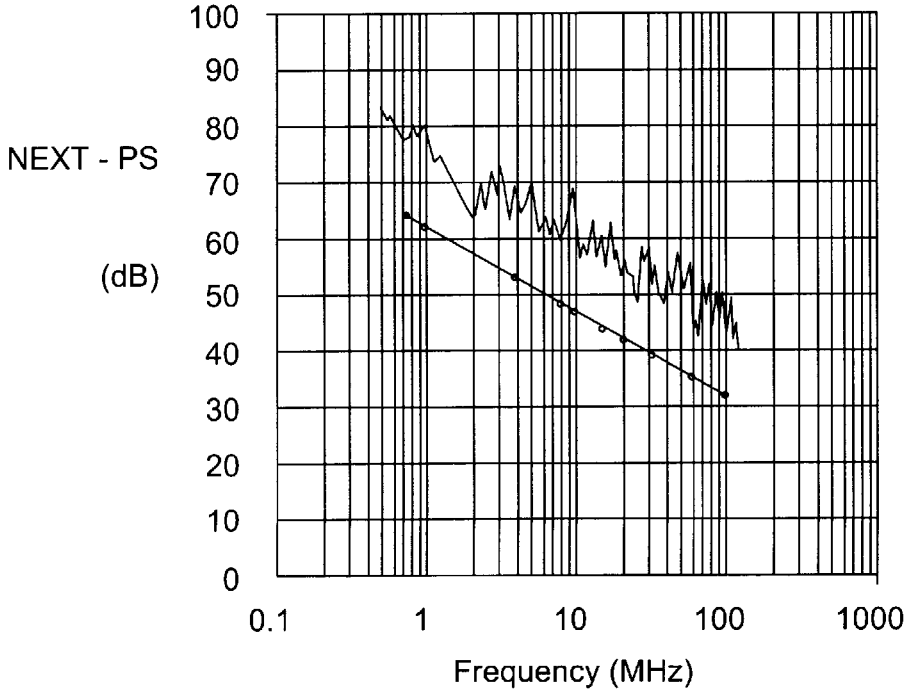
Figure 6A:
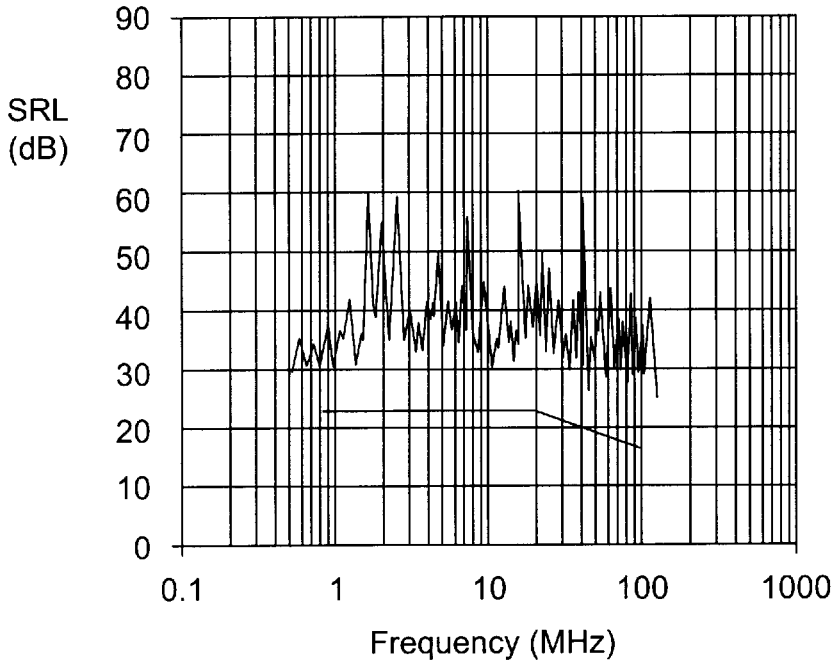
FIGS. 6A–6D are graphs of experimental structural return loss (SRL) test results for a cable configured in accordance with the present invention.
Figure 6B:
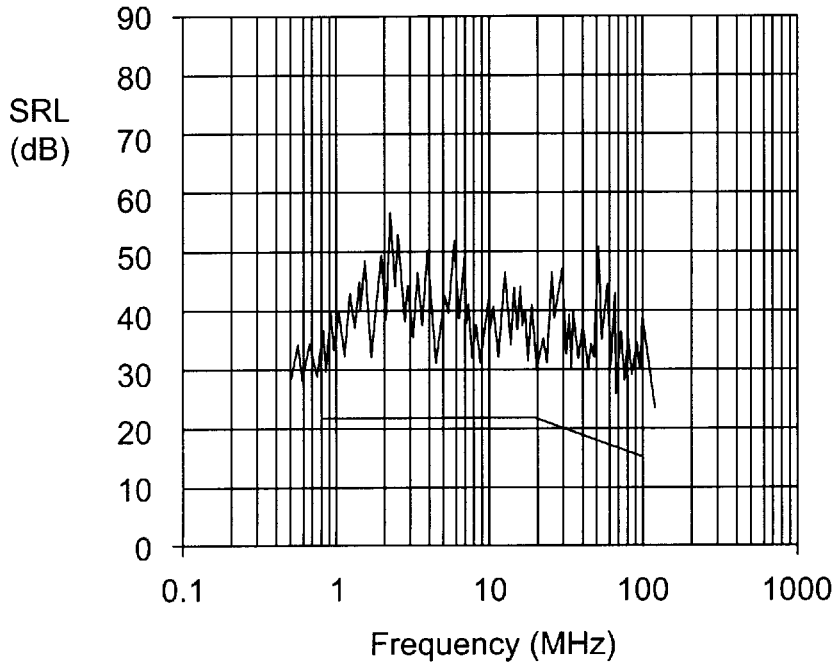
Figure 6C:
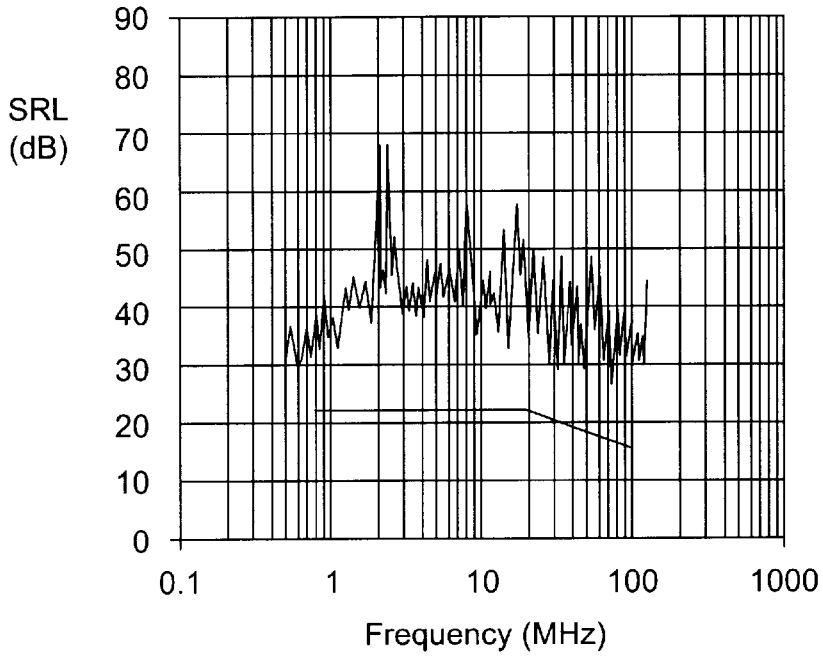
Figure 6D:
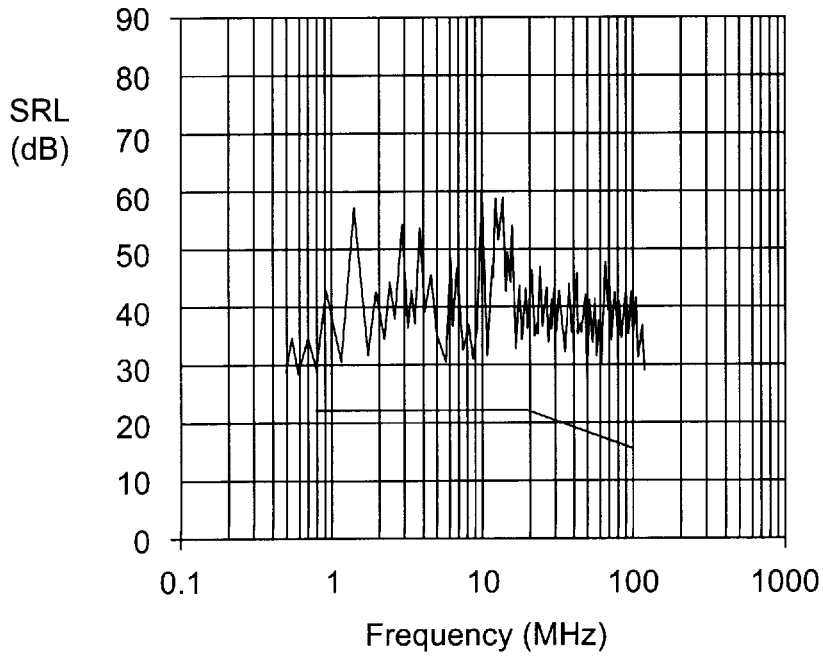

It is customary in the communication cable industry to specify the NEXT losses in terms of a power sum. In this context, a NEXT power sum for Pair #1 is obtained by adding the NEXT associated with Pair #2, Pair #3, and Pair #4. Due to the additive nature of this measurement, it is more difficult to pass the Category 5 NEXT requirements if power sums are utilized rather than the NEXT for each individual worst case pair. FIGS. 5A–5D are graphs depicting the NEXT power sums associated with the experimental data shown in FIGS. 4A–4F. As with the individual NEXT graphs, the straight lines in FIGS. 5A–5D represent the minimum acceptable NEXT loss for Category 5 cables. FIG. 5E is a table showing a number of experimental data points corresponding to the graphs of FIGS. 5A–5D.

All of the twisted pairs exceeded the Category 5 NEXT criteria, even though NEXT power sums were utilized. Specifically, the worst case margins of improvement over the Category 5 NEXT requirement for the various pairs were: Pair #1—6.5 dB measured at 2.0 MHz; Pair #2—6.2 dB measured at 2.1 MHz; Pair #3—5.4 dB measured at 22.0 MHz; and Pair #4—7.0 dB measured at 2.0 MHz. At 100 MHz, the margins of improvement over the Category 5 requirement were: Pair #1—12.6 dB; Pair #2—17.5 dB; Pair #3—13.4 dB; and Pair #4—15.7 dB. Repeated testing of this cable construction confirms that, at 100 MHz, the margin of improvement over the Category 5 NEXT requirement, for the NEXT power sum of the worst case pair, is at least 10 dB.

As described above, all Category 5 rated cables must meet certain SRL requirements. Previous embodiments of the present invention would marginally pass the Category 5 SRL criteria, particularly at the lower frequencies between 0.772 MHz and 20 MHz (100 meters of Category 5 cables must have SRL values greater than or equal to 23 dB between these frequencies). In contrast, current embodiments that employ the preferred twist lengths described above exceed the Category 5 SRL criteria. FIGS. 6A–6D are graphs of experimental SRL measurements performed on a cable constructed in accordance with the present invention, i.e., one using a PVDF outer jacket, air gap 16, and the preferred twist lengths for the four twisted pairs. The SRL measurements were for a 1000 foot length of cable, tested at a temperature of 68° F. The straight line segments represent the minimum SRL requirement for Category 5 cables.

For the sake of convenience, the worst case SRL values were taken from two frequency segments: 0.722 MHz to 20 MHz (the Category 5 requirement is 23 dB throughout this band); and 20 MHz to 100 MHz (where the Category 5 requirement follows the formula set forth above). The following values represent the improvement, in dB, over the respective Category 5 value for the given frequency: Pair #1—6.9 dB at 10.7 MHz, 6.0 dB at 45.0 MHz; Pair #2—7.9 dB at 0.778 MHz, 7.0 dB at 66.2 MHz; Pair #3—9.0 dB at 10.0 MHz, 8.6 dB at 32.8 MHz; and Pair #4—7.8 dB at 0.800 MHz; 7.6 dB at 29.7 MHz. Repeated testing of this cable construction confirms that, across the lower frequency band, the margin of improvement over the Category 5 SRL requirement is at least 5.0 dB; the margin of improvement is typically at least 6.0 dB across this band.

The communication cable industry often rates cables in terms of their ACR values. ACR refers to the ratio of attenuation to cross talk. The ACR value is a convenient way to quantify the performance of a cable, because attenuation increases and NEXT decreases as the signal frequency increases. Larger ACR values correspond to higher performance. In the context of this description, the ACR at a given frequency is calculated (in dB) by subtracting the attenuation value from an appropriate NEXT value. For example, the minimum ACR value for Category 5 cable at 100 MHz is 10 dB (the minimum NEXT loss at 100 MHz is 32.0 dB and the specified maximum attenuation at 100 MHz is 22.0 dB).

The ACR may be calculated with respect to the worst case NEXT for a given twisted pair. For example, the worst NEXT value of the following pair combinations will be utilized to determine the ACR for Pair #1: Pair #1/Pair #2; Pair #1/Pair #3; and Pair #1/Pair #4. Alternatively, the ACR may be calculated with respect to the NEXT power sum for the given twisted pair, i.e., for a given twisted pair, the attenuation value at a specified frequency is subtracted from the NEXT power sum at that frequency.

FIG. 7 is a table that includes experimental attenuation data for the exemplary cable described above in connection with FIGS. 4–6. Although the attenuation data alone does not show a significant improvement over previous "non-enhanced" embodiments of the present invention, the attenuation data is useful for determining the ACR values. It should be noted that the maximum attenuation values set forth in the Category 5 standard relate to a 100 meter length of cable. In contrast, the experimental data shown in FIG. 7 is for a 1000 foot length of cable, which is considerably longer than 100 meters. Consequently, the attenuation values in FIG. 7 would generally be lower for a 100 meter length of cable.

The exemplary cable associated with FIGS. 4–6 had the following ACR values, with respect to the worst case NEXT values, measured at 100 MHz: Pair #1—24.9 dB; Pair #2—31.0 dB; Pair #3—25.2 dB; and Pair #4—29.1 dB. Repeated testing of this cable construction has shown that, at 100 MHz, the ACR value for all twisted pairs is at least 18 dB, which far exceeds the baseline 10 dB ACR value reflected in the Category 5 Standard. Indeed, as indicated by the above data, the actual minimum ACR value (at 100 MHz) for practical cables may even be higher than 20 dB.

The same exemplary cable had the following ACR values, with respect to the NEXT power sums, measured at 100 MHz: Pair #1—23.3 dB; Pair #2—27.8 dB; Pair #3—24.3 dB; and Pair #4—27.0 dB. Repeated testing of this cable construction has shown that, at 100 MHz, the ACR values based on the NEXT power sum for all twisted pairs also exceeds 18 dB. Thus, even under the more rigorous NEXT power sum criteria, the above cable exceeds the Category 5 requirements. Indeed, as indicated by the above data, the actual minimum ACR value at 100 MHz (based on the NEXT power sums) may actually exceed 20 dB.

In accordance with the present invention, an improved cable construction is achieved, which is a result of a novel combination of electrical and burn properties of materials. Specifically, a cable with conductors having a primary insulation of foam/skin HDPE, surrounded by a jacket of thermoplastic halogenated polymer, such as foamed PVDF material, is capable of meeting or exceeding the Category 5 electrical requirements, the UL-910 plenum burn requirements, and the UL-444 physical property requirements.

Although the specific examples discussed herein have, for purposes of completeness, included identification of specific suitable materials available from various manufacturers, equivalent materials available now or hereafter can obviously be substituted with satisfactory results. It is intended, therefore, in the appended claims, to cover not only the specific materials and constructions which have been discussed herein, but also substitution of equivalent materials in the overall cable construction. For example, rather than the HDPE foam/skin insulation, a polypropylene foam/skin insulation may be utilized to improve the crush resistance and the overall physical robustness of the cable. In addition, the present invention may employ an HDPE skin/foam/skin triple extruded insulation or a polypropylene skin/foam/skin insulation for improved velocity of propagation values.

What is claimed is:

1. A communications cable for use in plenum applications, said cable comprising:

a plurality of conductors, each being individually enclosed by a substantially pure high density polyethylene (HDPE) insulation material, said plurality of conductors being configured as a plurality of twisted pairs arranged in a conductor core, each of said twisted pairs having a different twist length associated therewith;

a polyvinylidene fluoride (PVDF) outer jacket surrounding said plurality of conductors;

wherein said plurality of twisted pairs, said insulation material, and said outer jacket are cooperatively configured such that said communications cable passes the UL-910 plenum burn test, said cable meets the physical requirements set forth in the UL-444 communications cable standard, and the near end crosstalk (NEXT) loss for the worst-case combination of two of said twisted pairs, measured in decibels at 100 MHZ, is greater than or equal to:

$$74-15 \log (100/0.772)=42.3 \text{ dB};$$

said plurality of twisted pairs are arranged in said conductor core such that a first twisted pair generally opposes a second twisted pair and such that a third twisted pair generally opposes a fourth twisted pair;

said first twisted pair has a twist length in the range of 0.59 to 0.63 inches;

said second twisted pair has a twist length in the range of 0.53 to 0.57 inches;

said third twisted pair has a twist length in the range of 0.67 to 0.71 inches; and said fourth twisted pair has a twist length in the range of 0.76 to 0.80 inches.

2. A communications cable according to claim 1, wherein said plurality of twisted pairs, said insulation material, and said outer jacket are cooperatively configured such that said communications cable meets or exceeds the Category 5 electrical requirements set forth in the TIA/EIA 568A standard.

3. A communications cable according to claim 1, wherein said plurality of twisted pairs, said insulation material, and said outer jacket are cooperatively configured such that the NEXT power sum loss for the worst-case of said twisted pairs, measured in decibels at 100 MHz, is greater than or equal to:

$$74-15 \log(100/0.772)=42.3 \text{ dB}.$$

4. A communications cable according to claim 1, wherein said plurality of twisted pairs, said insulation material, and said outer jacket are cooperatively configured such that each of said plurality of twisted pairs has a structural return loss (SRL), for a length of 100 meters or longer, within a frequency range of $f$=0.772 MHz to $f$=20 MHz, of at least 28 dB.

5. A communications cable according to claim 1, wherein said plurality of twisted pairs, said insulation material and said outer jacket are cooperatively configured such that each of said plurality of twisted pairs has an attenuation to crosstalk ratio (ACR) of at least 18 dB at 100 MHz, calculated with respect to the worst-case NEXT value associated with the particular twisted pair.

6. A communications cable according to claim 1, wherein said plurality of twisted pairs, said insulation material and said outer jacket are cooperatively configured such that each of said plurality of twisted pairs has an attenuation to crosstalk ratio (ACR) of at least 18 dB at 100 MHz, calculated with respect to the NEXT power sum value associated with the particular twisted pair.

7. A communications cable according to claim 1, wherein said outer jacket is made of a foamed PVDF material.

8. A communications cable according to claim 1, further comprising an air gap defined between said conductor core and said outer jacket.

* * * * *